United States Patent [19]

Subotnick

[11] 4,180,924

[45] Jan. 1, 1980

[54] RUNNING SHOE WITH WEDGED SOLE

[75] Inventor: Steven I. Subotnick, Hayward, Calif.

[73] Assignee: Brooks Shoe Manufacturing Co., Inc., Philadelphia, Pa.

[21] Appl. No.: 908,344

[22] Filed: May 22, 1978

[51] Int. Cl.[2] ..... A43B 5/00; A43B 13/38

[52] U.S. Cl. ..... 36/129; 36/127; 36/104; 36/43

[58] Field of Search ..... 36/129, 81, 69, 71, 36/127, 103, 104, 43, 44, 92

[56] References Cited

U.S. PATENT DOCUMENTS

| | | | |
|---|---|---|---|
| 2,409,813 | 10/1946 | Timson | 36/105 |
| 2,936,536 | 5/1960 | Blustein | 36/68 |
| 4,124,946 | 11/1978 | Tomlin | 36/43 |

FOREIGN PATENT DOCUMENTS

| | | | |
|---|---|---|---|
| 1511344 | 2/1967 | France | 36/43 |

*Primary Examiner*—Patrick D. Lawson

*Attorney, Agent, or Firm*—Caesar, Rivise, Bernstein & Cohen, Ltd.

[57] ABSTRACT

A pair of running shoes. Each shoe includes an upper portion having an inner side and an outer side and a sole running the length of the shoe from the heel to the toe between the inner and outer sides of the upper portion. The sole is formed of a resilient material and comprises a wedge portion extending from the heel to a point beyond the arch of the wearer's foot and immediately to the rear of the first metatarsal head of the foot. The wedge portion is canted upward in the transverse direction from the outer side of the shoe to the inner side of the shoe so that during running a substantial portion of the sole makes contact with the ground during each step. The sole is constructed to be thicker at portions adjacent to heel than at portions adjacent to toe and is formed of an outsole, a midsole and an intermediate bevelled section disposed therebetween at the heel. The transverse wedge portion of the sole is formed by the midsole.

6 Claims, 4 Drawing Figures

RUNNING SHOE WITH WEDGED SOLE

This invention relates to athletic footwear and more particularly to running shoes.

Various athletic shoes particularly suited for running are commercially available. Such shoes commonly include a sole which is of uniform thickness between the inner (varus) side of the shoe and the outer (valgus) side of the shoe.

The human anatomy is such that when a person runs, or walks for that matter, the rear valgus portion of the heel of each foot makes initial contact during each step. The ground contacting foot then rolls inward, called pronation, whereupon the person's body weight is brought from the outside edge of the foot inward toward the center of the arch. The foot then rolls outwardly and toes off toward the great toe to complete a step.

It is widely recognized that the vast majority of runners exhibit improper pronation when running in prior art shoes, like those described above. To that end most people, while they initially land on the outside of the heel of the ground contacting foot and then roll inward, as described heretofore, the foot stays rolled inward. In addition, it has been shown that when running three to four times the gravitational force is applied to the outside edge of the foot, and in particular the heel area, than occurs when walking. The high force, concentrated at the heel area, coupled with the tendency of most runners to roll their feet inward forcefully during running results in increased shock to the foot and increased heel wear of the shoe being worn.

It is a general object of the instant invention to provide running shoes which overcome the disadvantages of the prior art.

It is a further object of the instant invention to provide running shoes which permit greater ground contacting surface area during running, thereby distributing impact shock more evenly.

It is a further object of the instant invention to provide a pair of running shoes for providing medialongitudinal arch support while lessening abnormal pronation of the foot as the arch flattens during running.

It is still a further object of the instant invention to provide in a pair of running shoes a sole construction which permits greater contact surface area than prior art shoes, thereby distributing impact shock more evenly during running, while providing medialongitudinal arch support and decreasing abnormal pronation.

These and other objects of the instant invention are achieved by providing a pair of running shoes. Each of said shoes has an upper portion having an inner side and an outer side and a sole running the length of the shoe from the heel to the toe between the inner and outer sides. The sole is formed of a resilient material and comprises a wedge portion extending from the heel to a point beyond the arch of the wearer's foot and immediately to the rear of the first metatarsal head of the wearer's foot. Each sole's wedge portion is canted upward in a transverse direction from the outer portion of the shoe to the inner portion of the shoe so that when the wearer is running a substantial portion of the sole makes contact with the ground.

Other objects and many of the attendant advantages of this invention will be readily appreciated as the same becomes better understood by reference to the following detailed description when considered in connection with the accompanying drawings wherein.

Figure 1:
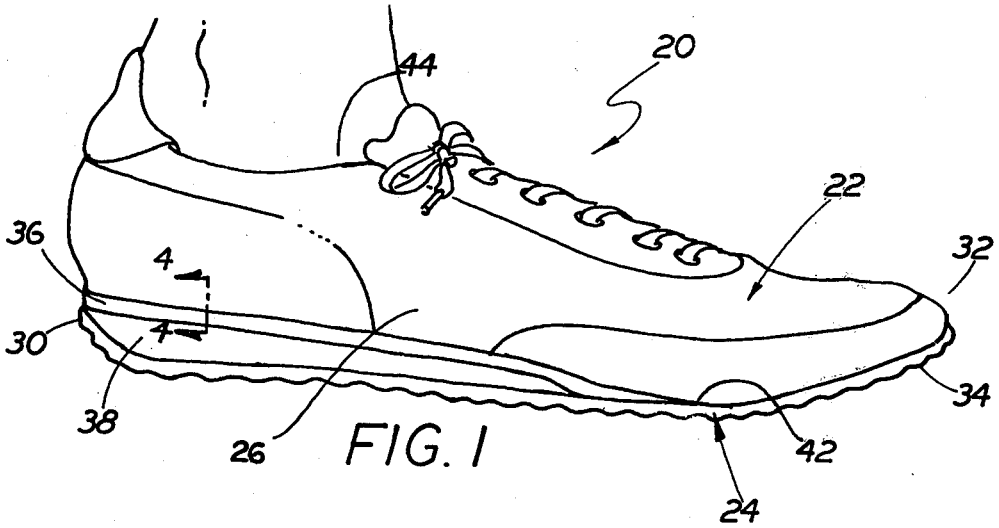
FIG. 1 is a side elevational view of one running shoe constructed in accordance with the instant invention.

Referring now to the various figures of the drawing wherein like reference characters refer to like parts there is shown at 20 one running shoe of a pair of running shoes constructed in accordance with the instant invention. Each shoe basically comprises an upper portion 22 and a sole 24. The upper portion 22 includes an inner or varus side 26 (FIG. 3) and an outer or valgus side 28. The sole runs the entire length of the shoe from the heel 30 to the toe 32 and between the varus and valgus sides 26 and 28, respectively. The upper portion 22 is of conventional construction and for that reason will not be described in detail herein.

The sole 24 of each shoe 20 is constructed in accordance with the instant invention to ensure that a greater portion of the sole makes contact with the ground during each step to distribute impact shock more evenly than prior art shoes, thereby resulting in decreased heel strike shock and uniform heel wear.

As can be seen in FIG. 1 the sole 24 is a tripartite construction basically comprising an outer sole 34, a midsole 36 and an intermediate bevelled section 38, each formed of a resilient and flexible material, such as rubber. The outer sole runs the entire length and width of the shoe and is arranged to contact the ground. In accordance with conventional construction practice the outer sole 40 is of substantially uniform thickness throughout and includes plural gripping elements, e.g., ridges, projecting outward from its underside.

The midsole 36 is constructed in accordance with the teachings of the instant invention and runs from the heel of the shoe 20 past the arch to a point, denoted by the reference numeral 42, located immediately to the rear of the location of the first metatarsal head of the wearer's foot 44. The midsole extends the full width of the sole between the varus and valgus sides of the shoe.

Figure 4:
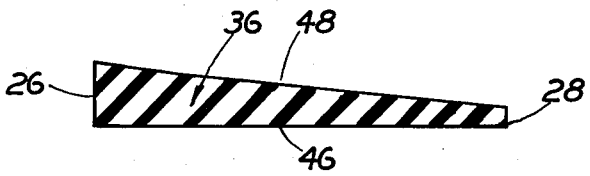
FIG. 4 is a sectional view taken along line 4—4 of FIG. 1.

As can be seen in FIG. 4 the transverse cross section of the midsole is wedge shaped. That is, the midsole includes a horizontal bottom surface 46 and a top surface 48 which is canted upward linearly at a slight angle, e.g., four degrees to the horizontal, transversely of the longitudinal axis of the shoe and in the direction from the valgus side 28 to the varus side 26. The upward cant extends along the midsole from the heel to immediately behind the first metatarsal head, i.e., point 42.

The upper portion of the shoe is secured onto the top surface 46 of the midsole. The bevelled intermediate section 38 of the sole is a wedge shaped element interposed and secured between the outer sole and the midsole and located at the heel of the shoe. The section 38 is of conventional construction and tapers upward in the longitudinal direction of the shoe from a point adjacent the arch toward the heel of the shoe to lift the heel of the upper portion with respect to the toe.

The outer sole 36 is secured to the bottom surface of the intermediate section 38, the bottom surface 46 of the midsole portion extending forwardly of the intermediate section 38 and the bottom of the shoe's upper portion 22 extending forward of the midsole. With the upper portion 22 of the shoe secured on the sole, the upper is approximately ⅛ inch (3.2 mm) higher on the varus side than on the valgus side from the heel of the shoe to the point immediately behind the first metatarsal head. The varus direction cant as just described, and as will be seen by reference to FIGS. 2 and 3 hereinafter, provides the advantages of shoes 20 over prior art shoes.

It must be pointed out at this juncture that while the sole 24 is shown as comprising a tripartite construction, such a construction is not essential to the instant invention. In this regard the sole of the shoe 20 can be constructed numerous ways and with any number of components, e.g., a unitary sole construction, a sole construction including only a midsole and an outsole secured together, etc., provided that a portion of the sole forms a transverse wedge which is canted upward from the valgus side to the varus side and which extends from the heel of the shoe to the point immediately behind the first metatarsal head. In addition, while the amount of cant has been described as being approximately four degrees, to result in the varus side being ⅛ inch (3.2 mm) higher than the valgus side, a greater amount of varus cant may be required for special orthopedic applications, e.g., bowleggedness of the wearer.

On page 66 of my book entitled, "The Running Foot Doctor", published by World Publications, copyright 1977, Library of Congress Catalog No. 77-73653, there is disclosed advantages of a varus wedge concentrated at the heel or at the arch area of a running shoe.

Figure 2:
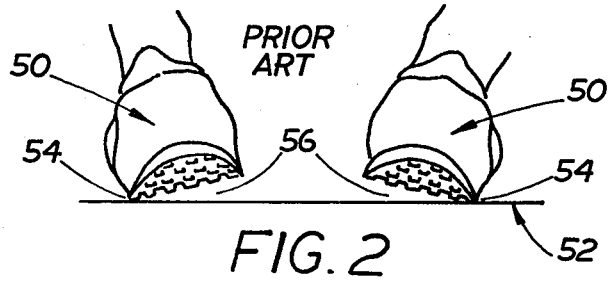
FIG. 2 is a rear elevational view of a pair of prior art running shoes showing how initial contact is made with the ground by each shoe.
Figure 3:
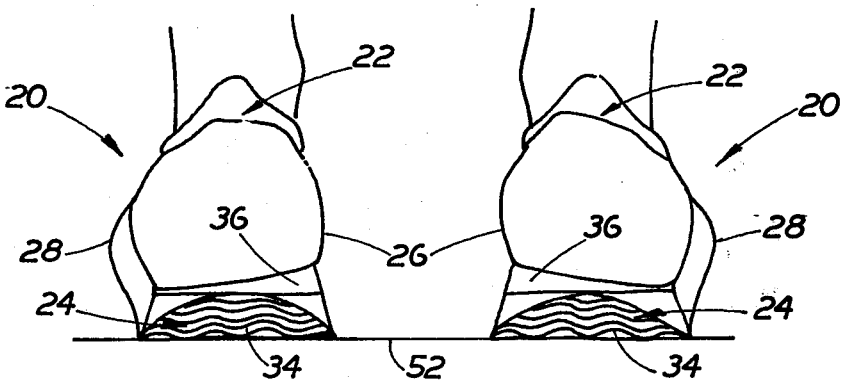
FIG. 3 is a view, similar to that of FIG. 2, but showing a pair of running shoes of the instant invention making initial contact with the ground.

In FIG. 2 there is shown a typical pair of prior art running shoes. As can be seen, as each shoe 50 strikes or makes contact with the ground 52 the valgus heel portion 54 makes contact first, with the varus portion of the sole spaced slightly at 56 above the ground. In contradistinction, as shown in FIG. 3, the presence of the transverse varus extending wedged sole of the instant invention in effect fills up the space 56 between the ground and the varus portion of the sole during the shoe's initial contact with the ground and places more sole surface in contact with the ground. This action decreases the tendency of the foot to forcefully turn in after initial contact and distributes the impact stress more evenly across the sole, thereby decreasing impact shock to make running more comfortable, while lessening the chance of the impact-caused injury. In addition, the distribution of stresses across a greater portion of the sole during initial contact results in less wear of the sole at the heel than with prior art shoes. Furtherstill, at the full foot contact position, i.e., when the entire foot is on the ground, the portion of the transverse varus extending wedged sole lieing under the inner (medialongitudinal) arch provides additional support to this area. Increased support at the inner arch lessens abnormal pronation of the foot as the arch flattens, thereby making the foot a stronger, more efficient structure. The decreasing of abnormal pronation at midstance also enables a more efficient toe-off to occur during the final phase of each step.

Without further elaboration, the foregoing will so fully illustrate my invention that others may, by applying current or future knowledge, readily adapt the same for use under various conditions of service.

What is claimed as the invention is:

1. A pair of running shoes, each of said shoes comprising an upper portion and a sole, said upper portion having an inner side and an outer side, said sole running the length of the shoe from the heel to the toe between the inner and outer sides, said sole being formed of a resilient material and comprising a wedge portion extending the full length of the heel to a point to the front of the arch of the wearer's foot and immediately to the rear of the first metatarsal head thereof, said wedge portion being canted upward in the transverse direction from the outer side of the shoe to the inner side of the shoe along the length of said wedge portion, so that when the wearer runs in said shoes a substantial portion of each sole makes contact with the ground during each step.

2. The running shoes of claim 1 wherein each of said wedge portions raises the inner portion of the associated shoe at least ⅛ inch (3.2 mm) with respect to the outer portion thereof.

3. The running shoes of claim 1 wherein each of said wedge portions is canted at least four degrees.

4. The running shoes of claim 2 wherein said sole is thicker adjacent the heel than adjacent the toe.

5. The running shoes of claim 4 wherein said sole comprises an outsole, an intermediate longitudinally bevelled section and a midsole, said midsole forming said wedge portion.

6. The running shoes of claim 1 wherein said cant is linear.

* * * * *